US007892401B2

(12) United States Patent
Crook

(10) Patent No.: US 7,892,401 B2
(45) Date of Patent: Feb. 22, 2011

(54) PRESS FABRIC TREATMENT

(75) Inventor: Robert Crook, Wilson, NC (US)

(73) Assignee: Voith Patent GmbH, Heidenheim (DE)

( * ) Notice: Subject to any disclaimer, the term of this patent is extended or adjusted under 35 U.S.C. 154(b) by 670 days.

(21) Appl. No.: 11/863,664

(22) Filed: Sep. 28, 2007

(65) Prior Publication Data

US 2009/0084460 A1 Apr. 2, 2009

(51) Int. Cl.
*D21F 7/08* (2006.01)
*D21F 7/10* (2006.01)

(52) U.S. Cl. ..... 162/358.2; 162/900; 162/904

(58) Field of Classification Search ..... 162/199, 162/348, 358.1, 358.2, 900, 902–904; 139/383 A, 139/425 A, 383 AA
See application file for complete search history.

(56) References Cited

U.S. PATENT DOCUMENTS 2,883,734 A 4/1959 Draper, Jr.
4,883,096 A * 11/1989 Penven ..... 139/383 A
5,204,150 A * 4/1993 Davenport ..... 428/58
6,425,985 B1 * 7/2002 Hagfors et al. ..... 162/358.2
7,105,465 B2 * 9/2006 Patel et al. ..... 442/88

* cited by examiner

*Primary Examiner*—Eric Hug
(74) *Attorney, Agent, or Firm*—Taylor IP

(57) ABSTRACT

A fabric for use in a papermaking machine, the fabric including a first end portion of the fabric having a first flexibility, and a second end portion of the fabric having a second flexibility. At least one of the first end portion and the second end portion is treated with an agent to reduce the flexibility associated therewith. The first end portion and the second end portion are coupled together. The agent is substantially removed from the first end portion and the second end portion. The reduced flexibility of the first end portion and/or the said second end portion define a stiffness that is substantially unaffected by a humid environment.

18 Claims, 2 Drawing Sheets

PRESS FABRIC TREATMENT

BACKGROUND OF THE INVENTION

1. Field of the Invention

The present invention relates to papermaking machines, and, more particularly, to press fabrics used in papermaking machines.

2. Description of the Related Art

In the papermaking process a fibrous slurry is formed and deposited onto a moving forming fabric in a forming section of a papermaking machine. A significant amount of water is drained from the slurry through the forming fabric, leaving the fibrous web on a surface of the forming fabric. The formed fibrous web passes from the forming section to a press section, which may include press nips or press belts. The fibrous web passes through the pressing section as compressive forces squeeze water from the web. The fibrous web proceeds to a drying section that may include one or more rotatable dryer drums or cylinders, such as Yankee dryers. The formed web may travel through a serpentine path sequentially around a series of drums, which serve to further drive the web into paper or fiberboard product.

The fabrics used in the forming, press and dryer sections all take the form of endless loops that are utilized by the papermaking machine and function in a manner that facilitates the conveyance of the web through its change from a slurry to a fibrous sheet.

Press fabrics are utilized in an endless belt form because a forming fibrous web is susceptible to marking in the press section and any non-uniformity in the press fabric may result in a marking on the paper. That is why it is important in the seaming region of a press fabric that the seam perform as the rest of the fabric or as closely thereto as possible. One method of seaming the belts together is the use of seaming loops that are formed in the machine direction yarns of the fabric. The seam is closed by bringing the two ends of the press fabric together by interdigitating the seaming loops at the ends of the fabric, and by directing a pin or pintel through the passage defined by the interdigitated seaming loops to thereby lock the ends of the fabric together.

What is needed in the art is a method of facilitating an accurate aligning of the ends of the fabric as well as facilitate the seaming thereof.

SUMMARY OF THE INVENTION

The present invention provides a fabric that is treated and seamed together and a method for treating the fabric thereof.

The invention in one form is directed to a fabric for use in a papermaking machine, the fabric includes a first end portion of the fabric having a first flexibility, and a second end portion of the fabric having a second flexibility. The first end portion and for the second end portion are treated with an agent to reduce the flexibility associated therewith. The first end portion and the second end portion are coupled together. The agent is substantially removed from the first end portion and the second end portion. The reduced flexibility of the first end portion and/or the said second end portion define a stiffness that is substantially unaffected by a humid environment.

An advantage of the present invention is that it is easier to seam ends of fabric that are not highly flexible.

Another advantage of the present invention is that the treatment is easily removed after the ends of the fabric are seamed together.

Another advantage of the present invention is that the treatment is removed from the fabric by the normal operation of the papermaking machine.

Yet another advantage of the present invention is that the stiffness of the end portions is substantially unaffected by prolonged storage in a high humidity environment.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
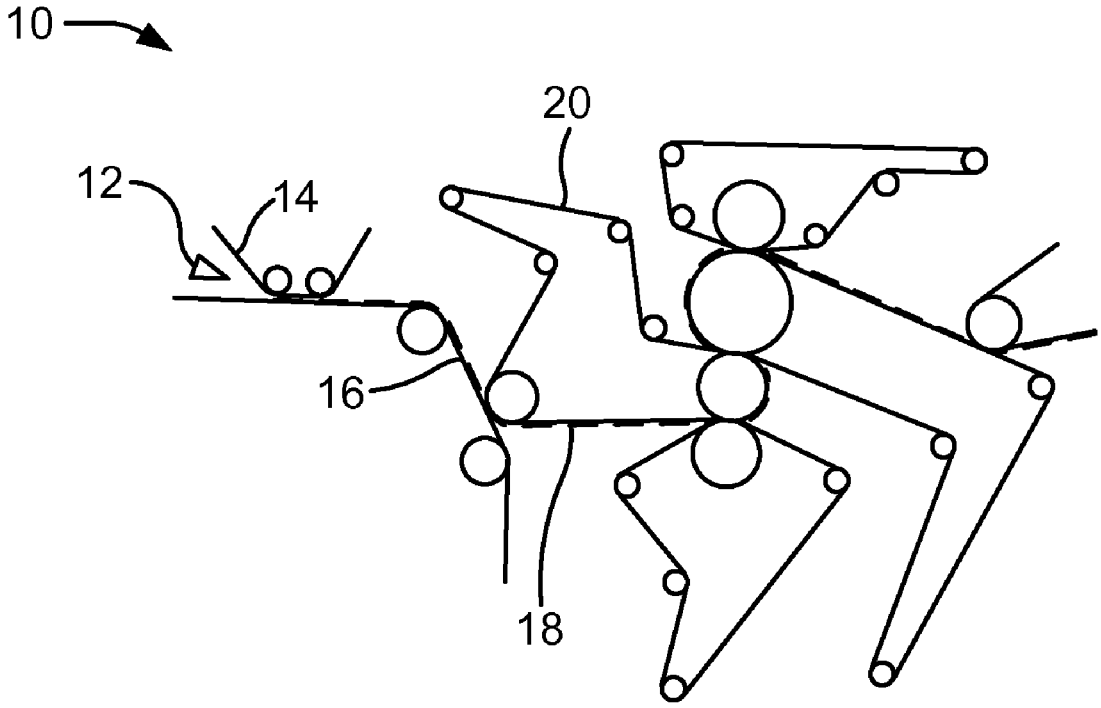
FIG. 1 schematically illustrates a side view of a papermaking machine utilizing an embodiment of a fabric belt of the present invention

Referring now to the drawings, and more particularly to FIG. 1, there is shown a schematicized view of an embodiment of the present invention of fabric belts being utilized in a papermaking machine 10. Papermaking machine 10 includes a headbox 12, a fabric belt 14, a fabric belt 16, between which a web 18 is formed and a press belt 20. Even though three belts are shown it is understood that papermaking machine 10 may have more or fewer belts than illustrated in FIG. 1. A slurry material containing cellulosic fibers is directed from headbox 12 into a gap between fabric belt 14 and fabric belt 16. Belts 14 and 16 come together around a roller and water is removed from the material allowing web 18 to be formed. Web 18 passes onto a press section having a press belt 20 where moisture is further removed.

Figure 2:
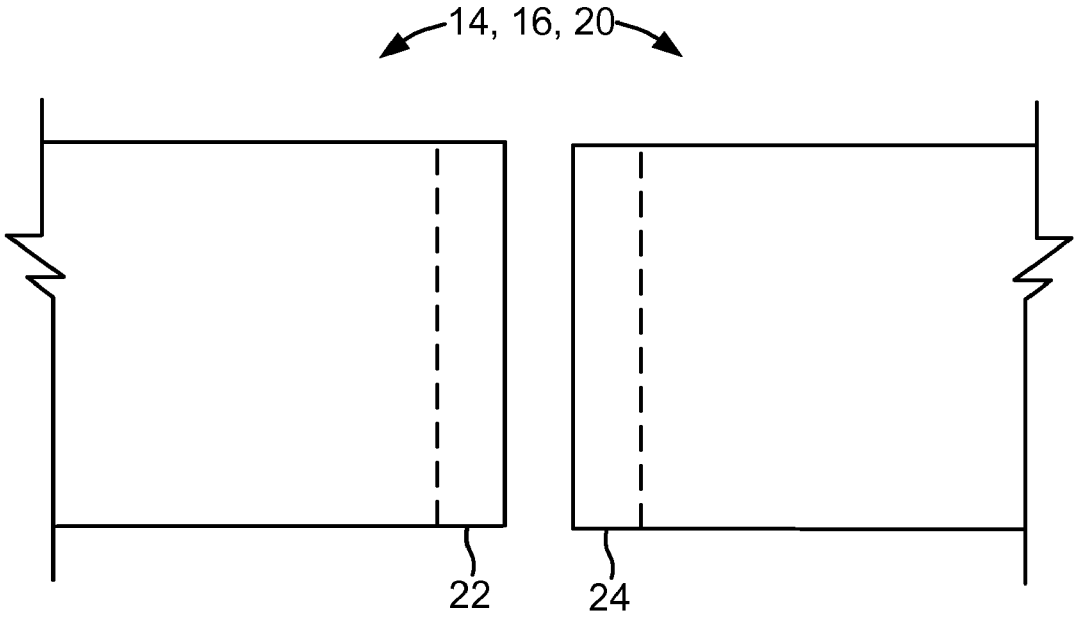
FIG. 2 is a schematicized top view of a fabric belt utilized in the papermaking machine of FIG. 1.
Figure 3:
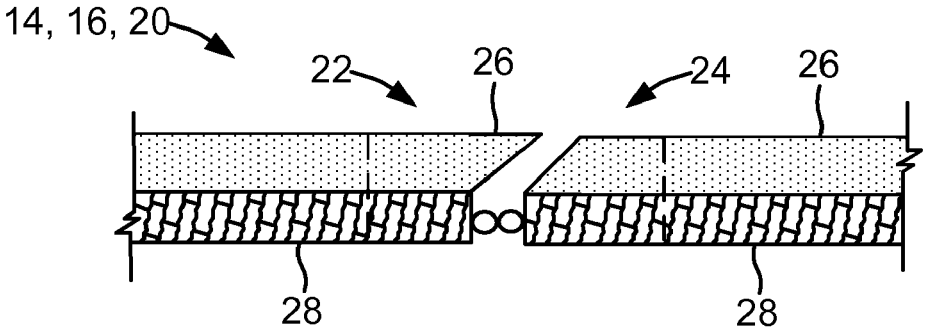
FIG. 3 is a cross-sectional view of the fabric of FIG. 2 utilized in the papermaking machine of FIG. 1.

Now, additionally referring to FIGS. 2 and 3 there is shown a belt 14, 16 or 20 having end portions 22 and 24 that are to be joined together. Although belts 14, 16, and 20 are discussed herein any of the other belts, which are not numbered can also be used with the present invention. Belt 14, 16 or 20 may have a batt layer 26 that is needled to a woven or non-woven fabric 28. End portion 22 and end portion 24 may be complimentarily shaped to enhance the bonding between the end portions and to reduce any marking protuberances that may extend from a surface of belt 14, 16 or 20. In the process of seaming end portions 22 and 24 together by way of joining loops or other features of the end portions it is advantageous to have the ends less flexible so they can be more easily aligned and seamed during that process. A treatment agent is applied to end portions 22 and for 24 to reduce the flexibility of belts 14, 16 and 20 at least in the end portions 22 and 24. Although the treatment can be applied to the entire belt 14, 16 or 20 since the seaming operation takes place in end portions 22 and 24 the present invention is described, for purposes of clarity, as only treating end portions 22 and 24. The treatment is applied so that the end portions become stiffer and are stiffened in a substantially linear fashion so that the end portions will properly align for more efficient seaming of the end portions together.

Once end portions 22 and 24 are seamed together the treatment agent is removed so that the water absorption characteristics and airflow characteristics in end portions 22 and 24 are not substantially different from the rest of belt 14, 16 or 20. The removal of the treatment agent can be an incidental treatment of simply operating the papermaking machine causing the treatment agent to fracture and depart from belt 14, 16 or 20.

The treatment agent may be a resin, such as polyvinyl acetate, phenoxy and/or may be a water-based treatment that imparts a stiff yet brittle characteristic to end portions 22 and 24. The brittle property of the coating leads to a short-term life of the treating agent once the belt is cycled through the papermaking machine 10. Since end portions 22 and 24 would be subjected to pressing pressures as well as bending moments the fracturing of the coating comes as a material with the operation of papermaking machine 10. The stiffer end portions 22 and 24 are easier to install, and in general the seaming area is easier and faster to join together.

Fabric 14, 16 or 22 may be pre-stiffened in the manufacturing operation by application of the thermoplastic resin, and more particularly a phenoxy resin. The phenoxy is a high molecular weight thermoplastic polyether resin based on bisphenol-A and epichlorohydrin with bisphenol-A terminal groups. The agent may be a water base type treatment, thereby being cost effective to apply. The agent may be considered a sacrificial resin application that has a brittle nature once applied, which leads to a short-term life once installed on papermaking machine 10. Once the treatment agent has been removed there is a permeability change of no more than 25% and preferably no more than 15% in end portions 22 and 24 as compared to untreated fabric in the rest of the fabric 14, 16 or 20. The treatment agent utilized on end portions 22 and 24 retains a stiffness even in hot and high humidity storage conditions yet it is brittle and a temporary bonding with the textile substrate. When installed on the papermaking machine the treatment quickly shatters and dissipates when exposed to the press nip and cleaning showers so there is little risk of it changing any performance of the fabric nor does the treatment change how the fabric is constructed. The treatment agent creates a stiffness when dry, but is also largely hydrophobic. The phenoxy resin, such as PKHW-34, from InChem of Rockhill, S.C., may be sprayed at approximately 5-25% solids in the seam area, also known as end portions 22 and 24. The quantity applied amounts to approximately 50 gsm of solids that are added on to the fabric. The treatment may be dried or cured at approximately 140° C. surface temperature with a 1.5 minute dwell time. End portions 22 and 24 may be approximately six inches in length across the full width of belts 14, 16 and 20.

Alternatively, the agent can be applied as a powder or a scrim. The agent applied is then melted to the fabric to provide the stiffness and other characteristics noted herein.

The agent applied in the treatment of end portions 22 and 24 substantially maintains the stiffness of end portions 22 and 24 while the belt is in storage even though the storage may be for a prolonged period of time and the storage condition include a humid and/or moist environment. It is the nature of the agent used in the present invention that interacts with end portions 22 and 24 to maintain the stiffness, yet have the flexibility and permeability of end portions 22 and 24 restored once belt 14, 16 or 20 is utilized in the papermaking machine. The fracturing of the agent when cycled a few times in the papermaking machine causes the agent to separate from the fabric of end portions 22 and 24 and to no longer influence the operation of the belt. Subsequent washing of the belt also serves to remove portions not separated from the belt once it is fractured. The removal of the agent can be considered a dissipation of the agent, which means that the agent is not interacting with the fabric and is so incidental that the agent may simply leave the papermaking machine as a part of the product, part of the belt washings or when routine cleaning is done in the work area in which the belt is being used.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fabric for use in a papermaking machine, the fabric comprising:

a first end portion of the fabric having a first flexibility; and a second end portion of the fabric having a second flexibility, at least one of said first end portion and said second end portion being treated with an agent to reduce at least one of said first flexibility and said second flexibility, said first end portion and said second end portion being coupled together, said agent being configured to be substantially removed from said first end portion and said second end portion after said first end portion and said second end portion are coupled together on the papermaking machine, said reduced flexibility of at least one of said first end portion and said second end portion defining a stiffness that is substantially unaffected by a humid environment, said agent substantially resists softening when exposed to moisture.

2. The fabric of claim 1, wherein said agent is water based.

3. The fabric of claim 1, wherein said treating step includes the step of spraying said agent upon said at least one end portion.

4. The fabric of claim 1, wherein said agent changes airflow through the fabric where said agent is applied by less than 25% after said agent is substantially removed.

5. The fabric of claim 1, wherein said agent temporarily bonds to the fabric.

6. The fabric of claim 5, wherein said agent dissipates once the fabric is used in the papermaking machine.

7. A fabric for use in a papermaking machine, the fabric comprising:

a first end portion of the fabric having a first flexibility; and a second end portion of the fabric having a second flexibility, at least one of said first end portion and said second end portion being treated with an agent to reduce at least one of said first flexibility and said second flexibility, said first end portion and said second end portion being coupled together, said agent being configured to be substantially removed from said first end portion and said second end portion after said first end portion and said second end portion are coupled together on the papermaking machine, said reduced flexibility of at least one of said first end portion and said second end portion defining a stiffness that is substantially unaffected by a humid environment, said agent being one of a phenoxy resin and polyvinyl acetate.

8. A fabric for use in a papermaking machine, the fabric comprising:

a first end portion of the fabric having a first flexibility; and a second end portion of the fabric having a second flexibility, at least one of said first end portion and said second end portion being treated with an agent to reduce at least one of said first flexibility and said second flexibility, said first end portion and said second end portion being coupled together, said agent being configured to be substantially removed from said first end portion and said second end portion after said first end portion and said second end portion are coupled together on the papermaking machine, said reduced flexibility of at least one of said first end portion and said second end portion defining a stiffness that is substantially unaffected by a humid environment, said agent creates a brittle bond with the fabric.

9. The fabric of claim 8, wherein said bond shatters and dissipates when the fabric is used in the papermaking machine.

10. A method of treating a fabric to be used in a papermaking machine, the method comprising the steps of:

treating at least one end portion of the fabric with an agent to reduce a flexibility of said at least one end portion, said at least one end portion including a first end portion and a second end portion, said reduced flexibility of said at least one end portion defining a stiffness that is substantially unaffected by a humid environment;

coupling said first end portion and said second end portion; and substantially restoring said flexibility of said first end portion and said second end portion, said agent is substantially resistant to softening when the fabric is placed in storage conditions.

11. The method of claim 10, wherein said agent is water based.

12. The method of claim 10, wherein said treating step includes the step of spraying said agent upon said at least one end portion.

13. The method of claim 10, wherein said agent changes a permeability of the fabric where said agent is applied by less than 25%.

14. The method of claim 10, wherein said agent forms a temporary bond with the fabric.

15. The method of claim 14, wherein said agent dissipates once the fabric is used in the papermaking machine.

16. A method of treating a fabric to be used in a papermaking machine, the method comprising the steps of:

treating at least one end portion of the fabric with an agent to reduce a flexibility of said at least one end portion, said at least one end portion including a first end portion and a second end portion, said reduced flexibility of said at least one end portion defining a stiffness that is substantially unaffected by a humid environment;

coupling said first end portion and said second end portion; and substantially restoring said flexibility of said first end portion and said second end portion, said agent being one of a phenoxy resin and polyvinyl acetate.

17. A method of treating a fabric to be used in a papermaking machine, the method comprising the steps of:

treating at least one end portion of the fabric with an agent to reduce a flexibility of said at least one end portion, said at least one end portion including a first end portion and a second end portion, said reduced flexibility of said at least one end portion defining a stiffness that is substantially unaffected by a humid environment;

coupling said first end portion and said second end portion; and substantially restoring said flexibility of said first end portion and said second end portion, said agent forming a temporary bond with the fabric, said agent creates a brittle bond with the fabric.

18. The method of claim 17, wherein said bond shatters and dissipates when the fabric is used in the papermaking machine.

* * * * *